US009149918B2

(12) United States Patent
Lee

(10) Patent No.: US 9,149,918 B2
(45) Date of Patent: Oct. 6, 2015

(54) L-SHAPED TORSIONAL WRENCH

(71) Applicant: Chang-Chuan Lee, Taichung (TW)

(72) Inventor: Chang-Chuan Lee, Taichung (TW)

( * ) Notice: Subject to any disclaimer, the term of this patent is extended or adjusted under 35 U.S.C. 154(b) by 119 days.

(21) Appl. No.: 13/794,254

(22) Filed: Mar. 11, 2013

(65) Prior Publication Data

US 2013/0239761 A1 Sep. 19, 2013

(30) Foreign Application Priority Data

Mar. 13, 2012 (TW) ..... 101108421 A

(51) Int. Cl.
*B25B 23/142* (2006.01)
*B25B 13/46* (2006.01)

(52) U.S. Cl.
CPC ..... *B25B 23/1427* (2013.01); *B25B 13/46* (2013.01)

(58) Field of Classification Search
CPC ..... B25B 23/1427; B25B 13/46
USPC ..... 81/467, 472, 473, 474, 476, 477
See application file for complete search history.

(56) References Cited

U.S. PATENT DOCUMENTS

| | | | | | |
|---|---|---|---|---|---|
| 3,772,942 | A * | 11/1973 | Grabovac | ..... | 81/483 |
| 5,662,012 | A * | 9/1997 | Grabovac | ..... | 81/483 |
| 6,948,410 | B1 * | 9/2005 | Larson | ..... | 81/467 |
| D520,822 | S * | 5/2006 | Hsieh | ..... | D8/24 |
| 7,174,817 | B1 * | 2/2007 | Hsieh | ..... | 81/478 |
| 2002/0040628 | A1 * | 4/2002 | Kemp et al. | ..... | 81/467 |
| 2008/0295656 | A1 * | 12/2008 | Hsieh | ..... | 81/467 |
| 2009/0293682 | A1 * | 12/2009 | Hsieh | ..... | 81/52 |
| 2013/0160617 | A1 * | 6/2013 | Hsieh | ..... | 81/467 |

* cited by examiner

*Primary Examiner* — David B Thomas

(57) ABSTRACT

An L-shaped torsional wrench is provided. The wrench includes a shell body, an elastic member, an L-shaped rod and a handle. A pushing member is assembled in the shell body and is movable between a first position and a second position along the shell body. The elastic member is compressed by the pushing member when the pushing member is located in the first position for compressing the elastic member. The pushing member is noncompressed by the elastic member when the pushing member is located in the second position so that the elastic member recovers from said compression for slowing the fatigue of the elastic member, extending the durability of the elastic member and keeping the torsional accuracy of the wrench.

8 Claims, 6 Drawing Sheets

L-SHAPED TORSIONAL WRENCH

BACKGROUND OF THE INVENTION

1. Field of the Invention

The present invention relates to a torsional wrench.

2. Description of the Prior Art

A torsional wrench includes a tube, a rod and a spring. The rod is received in the tube and is compressed by the spring. The rod will skew and hit an inner wall of the tube when a torsional force of the rod is larger than a compressing force of the spring. Under above arrangement, a user can exactly hear a hit sound and feel a hit vibration between the rod and the tube, and the user knows the torsional force that is too large. However, the spring is always compressed, so that an elasticity of the spring would be decayed soon.

The present invention is, therefore, arisen to obviate or at least mitigate the above mentioned disadvantages.

SUMMARY OF THE INVENTION

An object of the present invention is to provide a torsional wrench, in which the torsional wrench is able to slow the fatigue of an elastic member and to extend the durability of the torsional wrench.

To achieve the above and other objects, a L-shaped torsional wrench is provided. The wrench includes a shell body, an elastic member, a L-shaped rod and a handle.

The shell body has a first end, a second end and a receiving space. A pushing member is assembled at the first end and is movable between a first position and a second position along the shell body. A slipping member is assembled at the second end and is axially slidable along the shell body. The receiving space is defined between the pushing member and the slipping member.

The elastic member is received in the receiving space. The elastic member is compressed by the pushing member when the pushing member is located in the first position so that two ends of the elastic member are respectively abutted against the pushing member and the slipping member. The pushing member is noncompressed by the elastic member when the pushing member is located in the second position so that the elastic member recovers from said compression.

One end of the L-shaped rod abuts against the slipping member. The L-shaped rod slips off the slipping member when a torsional force between the L-shaped rod and the slipping member is larger than a recovery force of the elastic member.

The shell body is sleeved by the handle. The pushing member is drivable by the handle to move between the first position and the second position via operating the handle.

Wherein a user can adjust the recovery force of the elastic member of the present invention for slowing the fatigue of the elastic member, extending the durability of the elastic member and keeping the torsional accuracy of the wrench.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
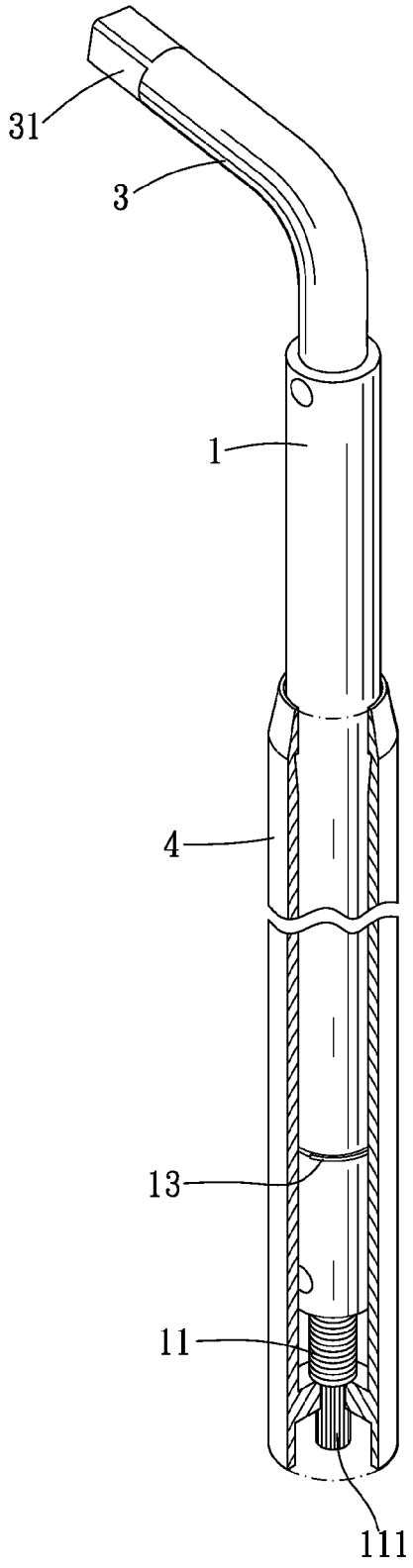
FIG. 1 is a perspective view of an L-shaped torsional wrench according to a preferred embodiment of the present invention.
Figure 2:
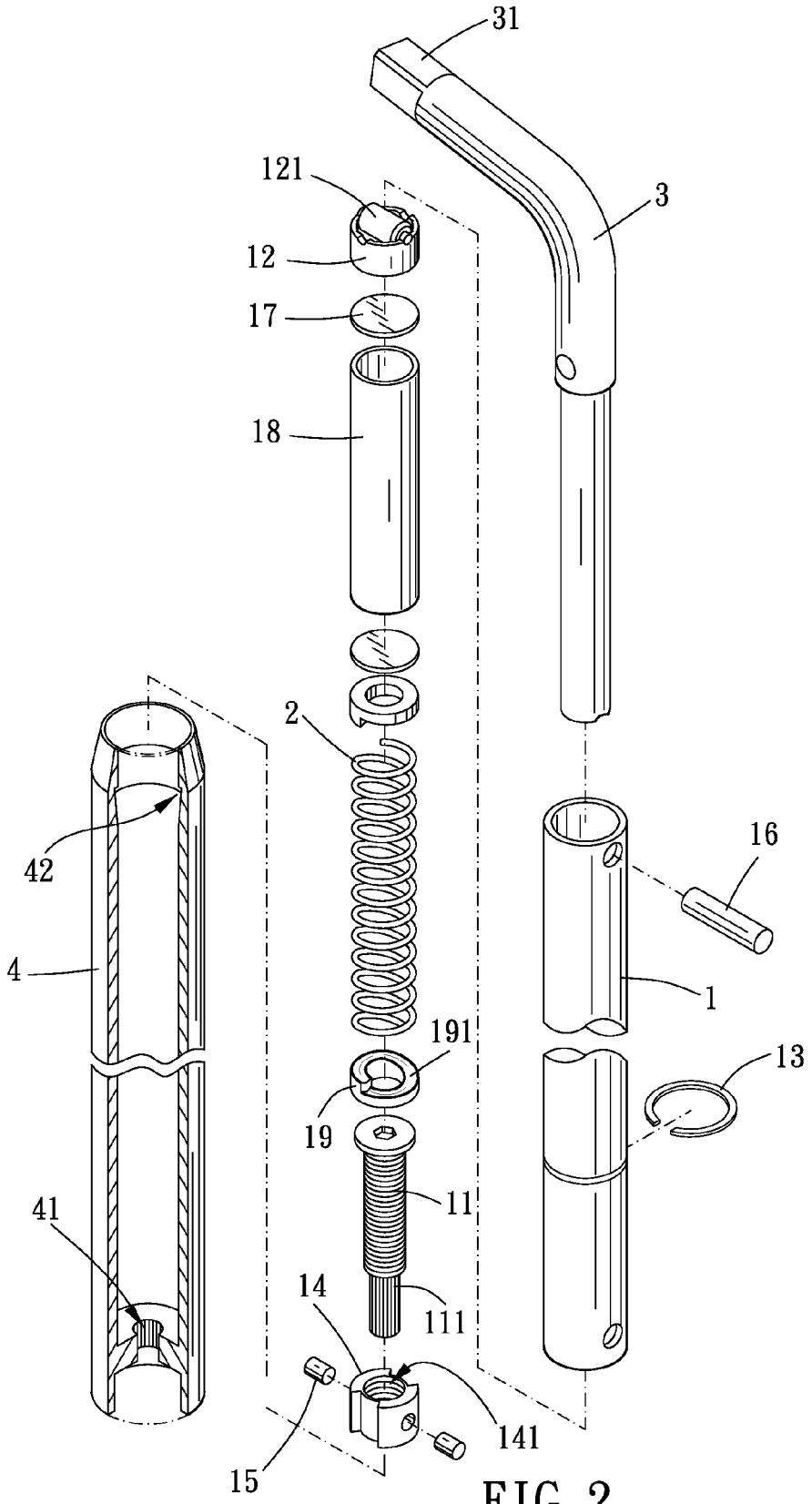
FIG. 2 is an exploded perspective view of the present invention.

FIGS. 1-2 show an L-shaped torsional wrench according to a preferred embodiment of the present invention. The wrench includes a shell body 1, an elastic member 2, an L-shaped rod 3 and a handle 4.

A hole is axially opened on the shell body 1 therethrough. The shell body 1 has a first end, a second end and a receiving space. The first end has a pushing member 11 and a base 14 both assembled therein. The pushing member 11 is movable between a first position and a second position along the shell body 1. The base 14 is received into the shell body 1. Two side pins 15 are respectively inserted into two lateral sides of the shell body 1 so as to be further inserted into the base 14 so that the base 14 is fastened onto the shell body 1. A screw hole 141 is axially opened on the base 14 therethrough. A plurality of threads is formed on an outer surface of the pushing member 11 so that the pushing member 11 is further screwed to the base 14. A slipping member 12 is assembled at the second end. A roller 121 is assembled at a top end of the slipping member 12. The slipping member 12 is axially slidable along the shell body 1. The receiving space is defined between the pushing member 11 and the slipping member 12.

The elastic member 2 is received in the receiving space and is a spring in the embodiment of the present invention. The elastic member 2 is compressed by the pushing member 11 when the pushing member 11 is located in the first position so that two ends of the elastic member 2 are respectively abutted against the pushing member 11 and the slipping member 12. The pushing member 11 is noncompressed by the elastic member 2 when the pushing member 11 is located in the second position so that the elastic member 2 recovers from said compression, and the elastic member 2 is free from any force. Besides, two contacting bases 19 are respectively assembled at two ends of the elastic member 2. Each contacting base 19 has a contacting surface 191 formed thereon. The contacting surface 191 of each contacting base 19 corresponds to each corresponding end of the elastic member 2. The contacting surface 191 is spiral-shaped so as to correspond to each end of the elastic member 2 so that the contacting base 19 is able to axially abut against the elastic member 2 for providing a stably supporting force for the contacting bases 19.

One end of the L-shaped rod 3 abuts against the slipping member 12. A through pin 16 passes through the L-shaped rod 3 and the shell body 1 so that the L-shaped rod 3 is pivoted on the shell body 1. A working end 31 is formed at another end of the L-shaped rod 3. The working end 31 is a rectangular wrench head in the embodiment. The L-shaped rod 3 slips off the slipping member 12 when a torsional force between the L-shaped rod 3 and the slipping member 12 is larger than a recovery force of the elastic member 2. In the embodiment, two washers 17 and a bush 18 are assembled between the slipping member 12 and the elastic member 2. The bush 18 is a hollow shell body. The two washers 17 are respectively placed at two ends of the bush 18. A distance between the slipping member 12 and the elastic member 2 is adjustable via the washers 17 and the bush 18, so that the recovery force of the elastic member 2 is adjustable.

A receiving hole is axially opened on the handle 4 therethrough. The shell body 1 is sleeved by the handle 4. The pushing member 11 is drivable by the handle to move between the first position and the second position via operating the handle 4. In the embodiment, a bottom end of the pushing member 11 is defined as an extending end 111. A cross-section of the extending end 111 is formed as a non-circular shape. A plurality of teeth is formed around an outer surface of the extending end 111. The handle 4 has a through hole 41. The extending end 111 is inserted into the through hole 41. A shape of the through hole 41 corresponds to the extending end 111, so that the handle 4 cannot be rotated relative to the extending end 111 when the extending end 111 is inserted into the through hole 41. When the handle 4 is rotated clockwise or counterclockwise, the pushing member 11 is rotated clockwise or counterclockwise via a rotation of the handle 4 so that the pushing member 11 is moved between the first position and the second position in the shell body 1 via the threads of the pushing member 11.

Figure 3A:
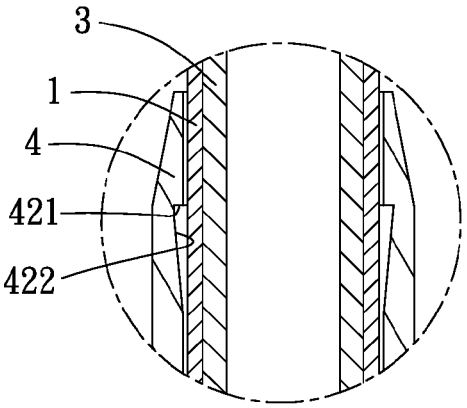
FIG. 3A is an enlarged and cross-sectional view of the present invention for showing a handle.
Figure 3:
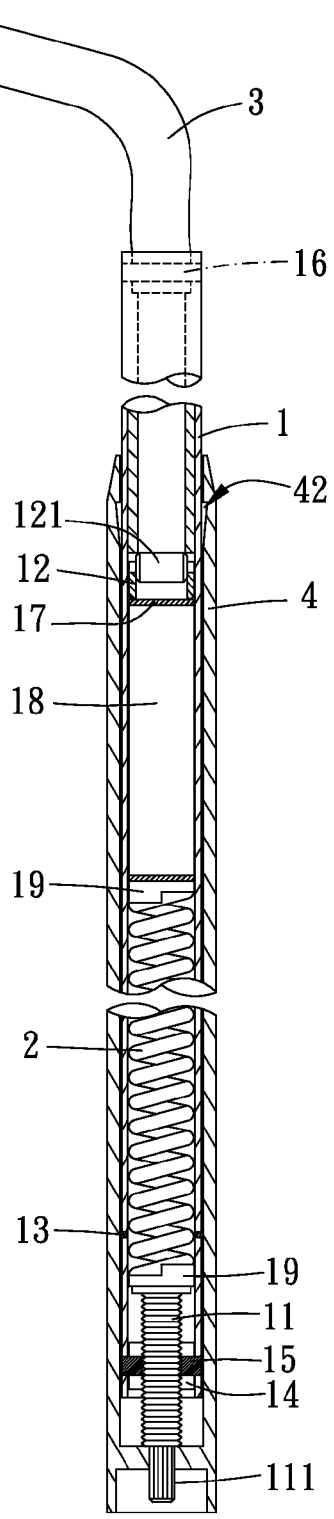
FIG. 3 is a cross-sectional view of the present invention for showing an elastic member is compressed by a pushing member.
Figure 4A:
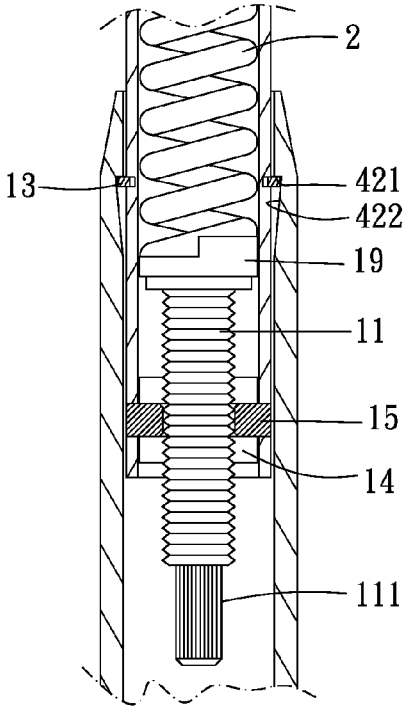
FIG. 4A is an enlarged and cross-sectional view of the present invention for showing a ring member abuts against a blocking surface.
Figure 4:
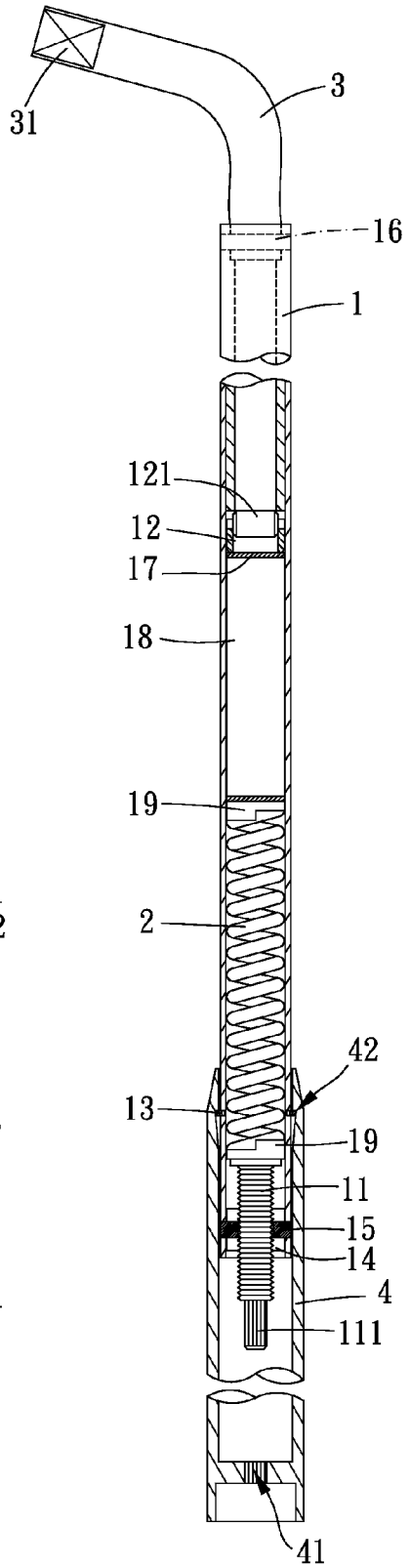
FIG. 4 is a cross-sectional view of the present invention for showing the elastic member is noncompressed by the pushing member.

The handle 4 is slidable relative to the shell body 1. A ring member 13 is socketed onto an outer surface of the shell body 1 and protrudes from the outer surface of the shell body 1. The ring member 13 is formed as a C-shaped ring. A diameter of the ring member 13 is larger than an inner diameter of the handle 4. The ring member 13 is able to be deformed via abutting against an inner surface of the handle 4. A limiting portion 42 is disposed on the inner surface of the handle 4. The limiting portion 42 includes a tapered surface 422 and a blocking surface 421. Referring to FIGS. 3-3A, the blocking surface 421 is horizontal, and the tapered surface 422 is vertically connected with the blocking surface 421. A diameter of the tapered surface 422 is gradually increased toward the blocking surface 421. The ring member 13 is inwardly compressed when the tapered surface 422 moves away from the ring member 13 via sliding the handle 4. Referring to FIGS. 4-4A, the handle 4 contacts the shell body 1 when the ring member 13 abuts against the blocking surface 421. The ring member 13 outwardly expands via sliding the handle 4, so that the handle 4 is slidable relative to the shell body 1. Referring to FIG. 3, the extending end 111 of the pushing member 11 is inserted into the through hole 41 of the handle 4 when the handle 4 is slid to a predetermined position, so that a user can adjust the recovery force of the elastic member 2 via rotating the handle 4.

Under above arrangement, firstly, the user can clockwise rotate the handle 4 when the extending end 111 is inserted into the through hole 41 so as to move the pushing member 11 to compress the elastic member 2, so that two ends of the elastic member 2 are respectively abutted against the pushing member 11 and the slipping member 12. The slipping member 12 abuts against the L-shaped rod 3 when the elastic member 2 is compressed by the pushing member 11. The L-shaped rod 3 slips off the slipping member 12 when the torsional force between the L-shaped rod 3 and the slipping member 12 is larger than the recovery force of the elastic member 2. A hit sound and a hit vibration between the L-shaped rod 3 and the shell body 1 would be felt because of said slipping off so that the user knows the torsional force is too large. Lastly, the user can counterclockwise rotate the handle 4 for moving the pushing member 11 from the elastic member 2, so that the elastic member 2 recovers from said compression and restores to an original length.

Figure 5:
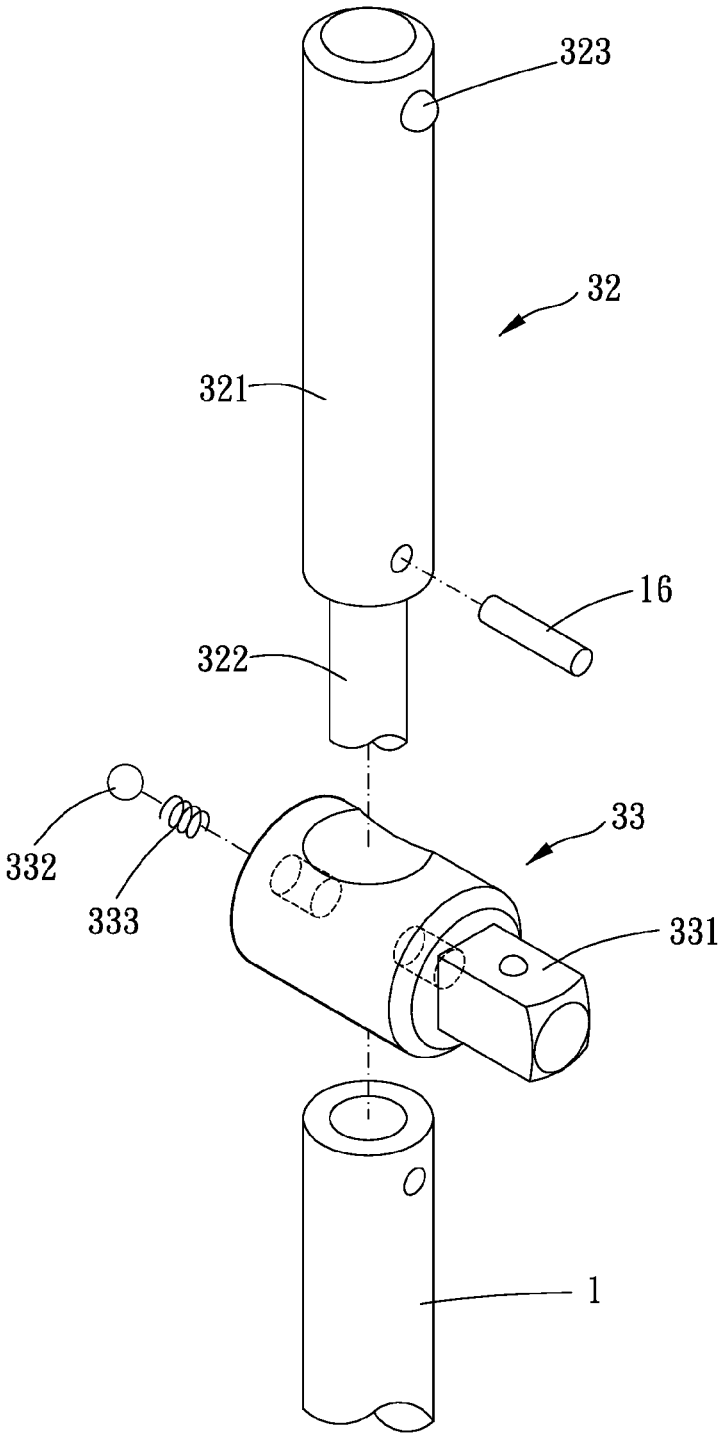
FIG. 5 is an exploded perspective view of a second embodiment of the present invention for showing a rod body is sleeved by a sliding member.
Figure 6:
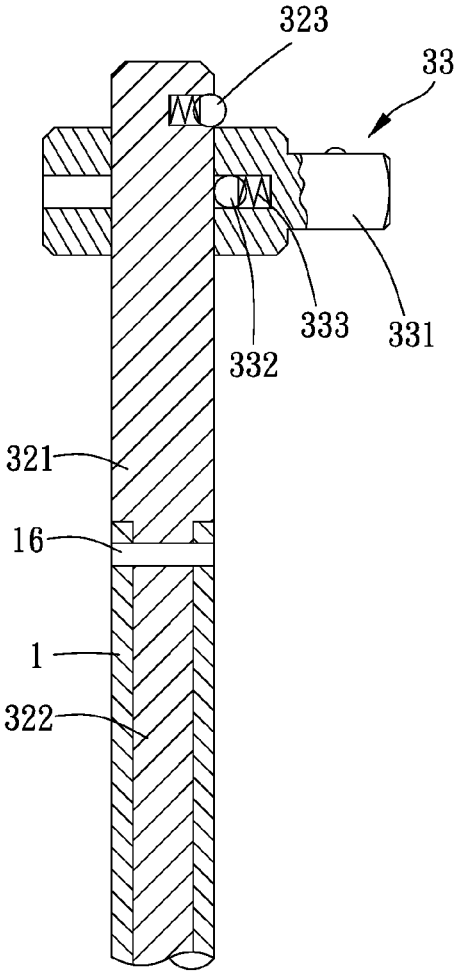
FIGS. 6-7 are cross-sectional view of the second embodiment of the present invention for showing the sliding member is slidable relative to the rod body.
Figure 7:
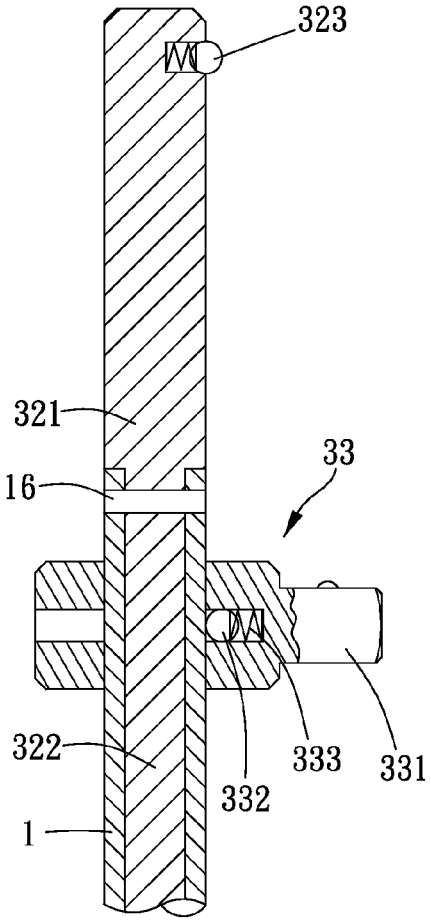

A second embodiment of the present invention is shown in FIGS. 5-7. The L-shaped rod 3 has a rod body 32 and a sliding member 33. The rod body 32 is sleeved by the sliding member 33 so that the sliding member 33 is slidable relative to the rod body 32 and the shell body 1. The rod body 32 includes a large diameter section 321, a small diameter section 322 and a protrusion 323. A diameter of the small diameter section 322 is smaller than that of the large diameter section 321. The small diameter section 322 is inserted into the shell body 1. The large diameter section 321 is sleeved by the sliding member 33. Referring to FIG. 6, the protrusion 323 is formed at a top end of the rod body 32. The protrusion 323 is protruded from an outer surface of the rod body 32 and is defined by a metallic ball in the second embodiment for limiting a motion of the sliding member 33. The sliding member 33 includes a positioning portion and a working portion 331. The positioning portion includes a ball 332 and a spring 333. Two lateral ends of the spring 333 are respectively abutted against the sliding member 33 and the ball 332 so as to push the ball 332 toward the rod body 32, so that the sliding member 33 can positioned on the rod body 32. Referring to FIGS. 6-7, the sliding member 33 is slidable between the rod body 32 and the shell body 1, so that the user can adjust an axial position of the sliding member 33 at the rod body 32 and the shell body 1 when a working space is limited.

Furthermore, the pushing member 11 is positioned at the first position when the user clockwise rotates the handle 4 to the end, so that the elastic member 2 is compressed, and then the L-shaped rod 3 can be torsionally operated. The pushing member 11 is positioned at the second position when the user counterclockwise rotates the handle 4 to the end, so that the elastic member 2 is noncompressed. Therefore, the user can clockwise or counterclockwise rotate the handle 4 to the end for compressing the elastic member 2 or not; in addition, the user feels the recovery force of the elastic member 2 via rotating the handle 4. It is not necessary to assemble an indicating member onto the wrench.

According to the above embodiments, the user can rotate the handle 4 for recovering the elastic member 2 when the wrench is idle, so that the elastic member 2 is noncompressed by the pushing member 11. Therefore, a life time of the elastic member 2 would be extended.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A L-shaped torsional wrench comprising:

a shell body, having a first end, a second end and a receiving space, a pushing member assembled at the first end and being movable between a first position and a second position along the shell body, a slipping member assembled at the second end and being axially slidable along the shell body, the receiving space defined between the pushing member and the slipping member;

an elastic member, received in the receiving space, the elastic member being compressed by the pushing member when the pushing member is located in the first position so that two ends of the elastic member are respectively abutted against the pushing member and the slipping member, the pushing member being noncompressed by the elastic member when the pushing member is located in the second position so that the elastic member recovers from said compression;

a L-shaped rod, one end thereof abutted against the slipping member, the L-shaped rod slipping off the slipping member when a torsional force between the L-shaped rod and the slipping member is larger than a recovery force of the elastic member; and a handle, disposed around the shell body, the pushing member being drivable by the handle to move between the first position and the second position;

wherein the handle is slidable relative to the shell body; a ring member is socketed onto an outer surface of the shell body and protrudes from the outer surface of the shell body; a limiting portion is disposed on an inner surface of the handle, the ring member is abutted against the limiting portion when the handle is moved to a predetermined position so that the handle is unslidable relative to the shell body.

2. The L-shaped torsional wrench as claimed in claim 1, wherein a washer is assembled between the slipping member and the elastic member for adjusting a distance between the slipping member and the elastic member.

3. A L-shaped torsional wrench, comprising:

a shell body, having a first end, a second end and a receiving space, a pushing member assembled at the first end and being movable between a first position and a second position along the shell body, a slipping member assembled at the second end and being axially slidable along the shell body, the receiving space defined between the pushing member and the slipping member;

an elastic member, received in the receiving space, the elastic member being compressed by the pushing member when the pushing member is located in the first position so that two ends of the elastic member are respectively abutted against the pushing member and the slipping member, the pushing member being noncompressed by the elastic member when the pushing member is located in the second position so that the elastic member recovers from said compression;

a L-shaped rod, one end thereof abutted against the slipping member, the L-shaped rod slipping off the slipping member when a torsional force between the L-shaped rod and the slipping member is larger than a recovery force of the elastic member; and a handle, disposed around the shell body, the pushing member being drivable by the handle to move between the first position and the second position;

wherein a washer is assembled between the slipping member and the elastic member for adjusting a distance between the slipping member and the elastic member.

4. A L-shaped torsional wrench, comprising:

a shell body, having a first end, a second end and a receiving space, a pushing member assembled at the first end and being movable between a first position and a second position along the shell body, a slipping member assembled at the second end and being axially slidable along the shell body, the receiving space defined between the pushing member and the slipping member;

an elastic member, received in the receiving space, the elastic member being compressed by the pushing member when the pushing member is located in the first position so that two ends of the elastic member are respectively abutted against the pushing member and the slipping member, the pushing member being noncompressed by the elastic member when the pushing member is located in the second position so that the elastic member recovers from said compression;

a L-shaped rod, one end thereof abutted against the slipping member, the L-shaped rod slipping off the slipping member when a torsional force between the L-shaped rod and the slipping member is larger than a recovery force of the elastic member; and a handle, disposed around the shell body, the pushing member being drivable by the handle to move between the first position and the second position;

wherein a bottom end of the pushing member is defined as an extending end, a cross-section of the extending end being formed as a non-circular shape, the extending end sleeved by the handle and rotated by a rotation of the handle so as to move the pushing member between the first position and the second position.

5. The L-shaped torsional wrench as claimed in claim 4, wherein a base is located at the first end of the shell body, the pushing member screwed onto the base.

6. The L-shaped torsional wrench as claimed in claim 5, wherein the base is received into the shell body, two side pins respectively inserted into two lateral sides of the shell body so as to be further inserted into the base so that the base is fastened onto the shell body.

7. The L-shaped torsional wrench as claimed in claim 6, wherein the elastic member is compressed when the handle is clockwise rotated to a predetermined position, and the elastic member is noncompressed when the handle is counterclockwise rotated to a predetermined position.

8. The L-shaped torsional wrench as claimed in claim 7, wherein the L-shaped rod has a rod body and a sliding member, the rod body sleeved by the sliding member so that the sliding member is movable relative to the rod body and the shell body.

* * * * *